US006950084B2

(12) United States Patent
Yamamoto et al.

(10) Patent No.: US 6,950,084 B2
(45) Date of Patent: Sep. 27, 2005

(54) IMAGE DISPLAY MEDIUM AND IMAGE FORMING APPARATUS

(75) Inventors: Yasuo Yamamoto, Minamiashigara (JP); Chisato Urano, Minamiashigara (JP); Yoshihiro Inaba, Minamiashigara (JP); Takeshi Matsunaga, Nakai-machi (JP); Yoshinori Machida, Nakai-machi (JP); Kiyoshi Shigehiro, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 310 days.

(21) Appl. No.: 09/963,546

(22) Filed: Sep. 27, 2001

(65) Prior Publication Data

US 2002/0060293 A1 May 23, 2002

(30) Foreign Application Priority Data

Sep. 29, 2000 (JP) ..... 2000-300961

(51) Int. Cl.[7] ..... G09G 3/36
(52) U.S. Cl. ..... 345/88; 345/72
(58) Field of Search ..... 345/72, 80, 84, 345/85, 86, 88, 90, 49, 30, 106, 107, 111, 98; 252/572; 359/296; 434/409; 428/321.5

(56) References Cited

U.S. PATENT DOCUMENTS 3,756,693 A * 9/1973 Ota ..... 345/107
3,875,576 A * 4/1975 Haas et al. ..... 347/112
4,032,226 A * 6/1977 Groner ..... 399/131
4,126,854 A * 11/1978 Sheridon ..... 345/107
5,411,398 A * 5/1995 Nakanishi et al. ..... 434/409
5,467,183 A * 11/1995 Snelling ..... 399/223
6,025,896 A * 2/2000 Hattori et al. ..... 349/86
6,045,955 A * 4/2000 Vincent ..... 430/45
6,113,810 A * 9/2000 Hou et al. ..... 252/572
6,130,774 A * 10/2000 Albert et al. ..... 359/296
6,221,267 B1 * 4/2001 Ikeda et al. ..... 216/24
6,362,915 B1 * 3/2002 Sheridon et al. ..... 359/296
6,369,793 B1 * 4/2002 Parker ..... 345/107
6,400,492 B1 * 6/2002 Morita et al. ..... 359/296
6,407,763 B1 * 6/2002 Yamaguchi et al. ..... 347/112
6,524,153 B1 * 2/2003 Ikeda et al. ..... 445/24
6,535,197 B1 * 3/2003 Comiskey et al. ..... 345/107
6,636,186 B1 * 10/2003 Yamaguchi et al. ..... 345/31
2002/0033793 A1 * 3/2002 Machida et al. ..... 345/107

FOREIGN PATENT DOCUMENTS

JP 01134347 A * 5/1989 ..... G02F/1/19
JP 05173193 A * 7/1993 ..... G02F/1/167
JP 05178645 A * 7/1993 ..... C03C/27/12
JP A 2000-98803 4/2000

OTHER PUBLICATIONS

Jo et al., "New Toner Display Device (1)", Japan Hardcopy 1999.

* cited by examiner

*Primary Examiner*—Vijay Shankar
*Assistant Examiner*—Nitin Patel
(74) *Attorney, Agent, or Firm*—Oliff & Berridge, PLC

(57) ABSTRACT

An image display medium capable of providing an image display with less change in the image density, with less change in the uniformness of the density and at stable density contrast even after repetitive rewriting over a long period of time, and an image forming apparatus using the image display medium are provided. The image display medium and image forming apparatus have a pair of facing substrates, at least two kinds of particles sealed in a space between the pair of the substrates in which the at least two kinds of particles have a characteristic that at least one kind of them is positively chargeable and at least one other kind of them is negatively chargeable, and the particles chargeable positively and negatively are of colors different from each other and a charge controller is internally added to one or both of the particles chargeable positively and negatively.

9 Claims, 1 Drawing Sheet

IMAGE DISPLAY MEDIUM AND IMAGE FORMING APPARATUS

BACKGROUND OF THE INVENTION

1. Field of the Invention

This invention concerns an image display medium capable of repetitive rewriting by using particles, and an image forming apparatus.

2. Description of the Related Art

As image display media capable of repetitive rewriting, display techniques such as twisting ball display (particle rotation display by plural separately colored particles), electrophoresis, magnetic phoresis, thermal rewritable medium and liquid crystals having memory properties have been proposed so far. The display techniques described above are excellent in the memory property of images but involve a problem that a surface cannot provide a white display face such as paper and the density contrast is low.

As a display technique using a toner for solving the problem described above, there has been proposed a display technique of sealing electroconductive colored toners and white particles between facing electrode substrates, injecting static charges to the conductive colored toners by way of a charge transportation layer disposed on the inner surface of the electrode substrate on the non-display side, in which the charge-injected conductive colored toners are moved by an electric field given between both of the electrode substrates to the electrode substrate on the display side situated facing the electrode substrate on the non-display side, and deposited to the inside of the electrode substrate on the display side to display images by the contrast between the conductive colored toners and the white particles (Japan Hardcopy' 99 Reports p 249–252). This display technique is excellent in that all the image display media are constituted with solid materials and white and black (color) display can be switched to 100% in principle. However, in the technique described above, conductive colored toners not in contact with the charge transportation layer disposed on the inner surface of the electrode of the non-display substrate and the conductive colored toners separated from other conductive colored toners are present and such conductive colored toners are not moved by the electric field since the charges are not injected and present at random between both of the electrode substrates, so that it results in lowering of the density contrast.

Japanese Published Unexamined Patent Application No. 2000–98803 discloses an image display medium including a voltage application unit such as a charging roller, a magnetic roller, an exposing unit and a photoreceptive support as an image display medium substrate, in which two different kinds of fine particles including magnetic toners and non-magnetic toners are disposed between the substrates. In this medium, the magnetic toners are moved in accordance with the charges applied by the charging roller, then injected with charges from the photoreceptive support only at an exposure portion, to be neutralized with charges and loss possessed charges and then retracted by the magnetic roller. Image display is conducted by the contrast of the relative movement by the contrast of movement between the magnetic toners and the non-magnetic toner. The magnetic toners in this system are charge injection type toners with a lower electric resistance value. This system requires an on-demand image injection mechanism upon image display, which complicates the image forming mechanisms. Further, although the publication describes that the toners include a charge controller, it does not suggest the addition of a charge controller in insulative toners charged frictionally to each other.

The present inventors have proposed an image display device including a pair of substrates, plural kinds of particle groups sealed movably between the substrates by an applied electric field between the substrates and different in the color and the charging characteristics (Japanese Patent Application No. 2000–165138). According to this proposal, high whiteness and density contrast are obtained. The constitution of the particles in this proposal is excellent in the white density, the black density and the density contrast at the initial stage but, when conducting repetitive writing over a long time, the image density is sometimes lowered to lower the density contrast or the image uniformity is lowered to cause unevenness in the images.

SUMMARY OF THE INVENTION

In view of the foregoing, the present invention provides an image display medium and an image forming apparatus capable of providing an image display, with less change of the image density and with less change of the density uniformness and at stable density contract even after repetitive rewriting over a long period of time.

As a result of an earnest study, it has been found that the problems described above are caused by instabilization of charged amount due to frictional charging between each of the particles. Then, the present invention has been accomplished based on the finding that internal addition of a charge controller to the particles is effective for stabilizing the charged amount due to frictional charging between each of the particles.

That is, the present invention provides an image display medium including a pair of facing substrates, at least two kinds of particles sealed in a space between the pair of substrates. The at least two kinds of particles have a characteristic that at least one kind of them is positively chargeable and at least one other kind of them is negatively chargeable, and the particles chargeable positively and negatively are of colors different from each other, and a charge controller is internally added to one or both of the particles chargeable positively and negatively.

The particles chargeable positively and negatively are different from each other in the color and a charge controller is internally added to at least one of the particles. Since the color is different between both of the particles, contrast can be obtained between an image area including one of the particle groups and an image area including the other of the particle groups. Further, since the charge controller is internally added to at least one of the particle groups, the charged amount of the particles is controlled by the kind and the addition concentration on the charge controller, with no substantial effect of other compositional ingredients (colorant, resin and the like) contained in the particles. When compared with a case of depositing a charge controlling substance to the outside of the particle surface, since such deposited charging substance does not transfer to the surface of other particles, the charge controller does not transfer to the surface of the particles, so that it is possible to provide an image display with less change of the image density and less change of the density uniformness and, at stable density contrast even upon repetitive rewriting over a long period of time.

In the present invention, particles have a characteristic that at least one kind of the particles in the two or more kinds of the particles is charged by frictional charging with at least one kind of the other particles and they are charged to the state polarized to each other in the charging series. Since the charge controller provides an appropriate charged amount, stable charge retainability and favorable flowability to the particle groups containing the controllers, the particle groups can move between a pair of substrates repetitively with no strong deposition to the inner surface of the substrates by the electric field applied between the pair of substrates. By the application of an electric field depending on image signals, the particle groups can be separated depending on the polarity and moved to the substrate on the opposite direction, so that images including contrast between different colors can be displayed on the substrate. Further, even when the electric field disappears, the particle group moved to the surface of the substrate can remain there by the imaging force or mirror imaging force and the van der Waals force to maintain the images. After the lapse of time, when the electric field is applied again, the particle group can move again. As described above, images can be displayed repetitively by applying an electric field from the outside in accordance with the images. At least two kinds of colors may suffice for the particle groups.

In the image display medium according to the present invention, it is desirable that the charge controller is colorless, of less coloring capability or of a hue similar to that of the entire particles contained.

Further, it is preferred that one of particles chargeable positively and negatively is white, the particles contain a colorant and that the colorant is titanium oxide.

The image forming apparatus according to the present invention is an apparatus for forming images to the image display medium according to the present invention described above and it includes an electric field generation unit for generating an electric field in accordance with images between the pair of substrates.

BRIEF DESCRIPTION OF THE DRAWINGS

Preferred embodiments of the present invention will be described in details with reference to the drawings, wherein.

PREFERRED EMBODIMENTS OF THE INVENTION

Figure 1:
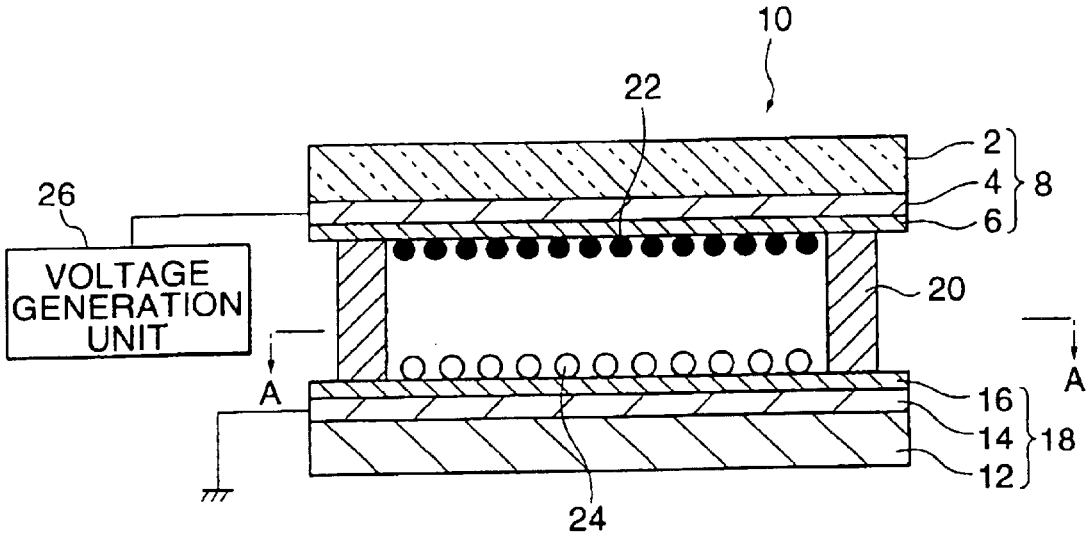
FIG. 1 is a schematic constitutional view illustrating an embodiment of an image forming apparatus according to the present invention using an image display medium according to the present invention.

This invention is to be explained more specifically.

[Operation Mechanism of the Invention]

The operation mechanism of the present invention is to be explained.

At least two or more kinds of particles sealed in a space between a pair of facing substrates are mixed and stirred at a predetermined ratio for their amount in a stirring container. It is considered that frictional charging occurs between the particles to each other and between particles and the inner wall of the container in the course of this mechanical mixing under stirring to charge each of the particles. Subsequently, mixed particles are sealed in a space between the pair of substrate so as to provide a predetermined volumic fillage ratio. The sealed particles reciprocate between the substrates in accordance with the electric field by the polarity switching of a DC voltage or application of an AC voltage between the pair of the substrate (initializing step). It is considered that each of the particles collides against each other and collides against the surface layer of the substrate to be charged frictionally also in the initializing step. Further, a desired triboelectrically charged amount can be obtained by the initializing step.

By the frictional charging described above, at least one kind of the particles is charged positively (positively charged particles are hereinafter referred to as first particles), while at least one kind of other particles is charged negatively (negatively charged particles are hereinafter referred to as second particles), respectively. While they tend to adhere and cohere to each other by the coulomb force between the first particles and the second particles, respective particles are separated in accordance with the electric field applied at the last of the initializing step and they are deposited to the respective substrates.

Then, when an electric field is applied in accordance with image signals, the first particles and the second particles are separated and moved in accordance with the electric field and are deposited respectively to different substrates. That is, it is considered that if the electrostatic force exerting on individual charged particles overcomes the coulomb force between each of the particles, the imaging force between the particles and the surface of the substrate or the force due to contact potential difference, then each of the particles is separated, moved to and deposited on the opposite substrates respectively.

It is considered that the particles deposited on the surface of the substrate are adhered and fixed on the surface of the substrate by the imaging force or the van der Waals force caused relative to the surface of the substrate. Then, when the chargeability for each of the particles is high, cohesion force between the particles is increased making the separation difficult. Further, particles of higher chargeability show increased deposition to the surface of the substrate, to increase a possibility of being secured on the surface of the substrates not moved by the applied electrical field. It is considered that when the highly chargeable cohered particles are separated, localized discharge may possibly be caused making the chargeability for each of the particles instable.

On the other hand, when the chargeability of the particles is lower and there is no substantial difference for the chargeability between the first particles and the second particles, each of the particles is scarcely separated by the static electric force due to external electric field but it is kept in a loosely cohered state.

As explained above, it can be seen that it is important for the particles to have a triboelectrical characteristic that each of the particles has an appropriate charged amount and contain less particles charged to opposite polarity in order that particles of different polarity are separated by the external electric field.

Then, in a case of moving the particles repetitively by switching the polarity of the electric field, it is sometimes observed that the chargeability of the particles is increased by the friction between each of the particles and the friction between particles and the surface of the substrate to cause cohesion between the particles or the particles are secured on a surface layer of the substrate. In this case, the charged amount of the particle groups causing the image unevenness is in a broad distribution from the higher value to the lower value. Accordingly, it is considered important that the charging characteristic of the particles hardly changes in order to keep the initial operation state.

As a charge controlling method, there is a controlling method of providing fine particles such as fine inorganic oxide particles or fine resin particles on the surface of the particles. However, this brings about problems, by the collision or friction between first and the second particles, such as lowering of the charged amount by the transfer of the fine particles to the mating particles (first particles or second particles) and/or transfer to the transparent electrode substrate and lowering of the display contrast due to the change of the powder flowability.

For keeping the charging property and keeping the flowability of the first particles and the second particles, it is important to avoid the change of the positional relation between the surface of the first particles and the second particles with the fine particle.

In the present invention, the foregoing problems are overcome by internally adding the charge controller (23) to at least one of the first particles and the second particles. That is, by internally adding the charge controller to at least one of the particles, the charged amount of the particles is controlled by the kind and the addition concentration of the charge controller with no substantial effect on other constitutional ingredients (colorant, resin and the like ) contained in the particles. When compared with a case of depositing a charge controlling substance to the outside of the particle surface, since such deposited charging substance does not transfer to the surface of other particles, the charge controller does not transfer to the surface of the particles, so that it is possible to provide an image display with less change of the image density and less change of the density uniformness at stable density contrast even after repetitive rewriting over a long period of time.

The foregoing explanation is based on the premise that there is each one kind for the positively charging first particles and the negatively charging second particles, but both of the particles may include only one kind or two or more kinds, and the effect of the present invention can be provided by the same operation mechanism as described above also in a case of using two or more kinds of particles.

[Constitution of Particles in the Invention]

The particle in the present invention includes, at least, a colorant, a charge controller and a resin. The colorant may function also as the charge controller in this constitution.

The colorant is used in the present invention can include the followings.

A black colorant can include black materials such as carbon black, titanium black, magnetic powder, as well as oil black, organic or inorganic dyes and pigments.

A white colorant can include those white pigments such as rutile type titanium oxide, anatase type titanium oxide, zinc white, lead white, zinc sulfide, aluminum oxide, silicon oxide and zirconium oxide.

Other chromatic colorants can include, for example, dye and pigments of phthalocyanine type, quinacridone type, azo type, condensed type, insoluble lake pigment or inorganic oxide type. Specifically, they can include, for example, aniline blue, chromium yellow, ultramarine blue, Dupont oil red, quinoline yellow, methylene blue-chloride, phthalocyanine blue, malachite green oxalate, lamp black, rose Bengal, C.I. pigment red 48:1, C.I. pigment red 122, C.I. pigment red 57:1, C.I. Pigment Red 177, C.I. pigment red 245, C.I. pigment violet 23, C.I. pigment yellow 97, C.I. pigment yellow 180, C.I. pigment yellow 185, C.I. pigment yellow 139, C.I. pigment yellow 138, C.I. pigment blue 15:1 and C.I. pigment blue 15:3, C.I. pigment blue 15:6, C.I. pigment green 36 as typical examples.

It is preferred that one of positively and negatively chargeable particles in the present invention is white, that is, the colorant in one of the positively and negatively chargeable particles in the present invention is a white colorant. By making one of the particles white, the coloring power and the concentration contrast of the other particles can be enhanced. In this case, titanium oxide is preferred as a colorant for making one of the particles white. When titanium oxide is used for the colorant, the hiding power can be increased in the range of the visible light wave length and the density contract can further be improved.

The structure of the colorant also serving as the charge controller can include those having electron attracting groups or electron donating groups or of metal complexes. Concrete examples can include C.I. pigment violet 1, C.I. pigment violet 3, C.I. pigment black 1 and C.I. pigment violet 23.

The addition amount of the colorant is preferably within a range from 1 to 60 mass % based on the entire particles and, it is more preferable within a range from 5 to 50 mass % assuming the specific gravity of the colorant being 1.

The charge controller characteristic in the present invention is a chemical capable of generating positive or negative charges to the surface of the toners by friction and controlling the magnitude of the charged amount, speed for the generation of charges, charge retainability and uniformness for the charge distribution of particles by addition to the particles in the present invention. A general chemical structure of the charge controller can include, for example, those having electron donating property or of a quaternary ammonium salt structure for positive charging and those having electron attracting groups or of an organic metal chelate structure for negative charging.

Known charge controllers used for the toner materials for use in electrophotography can be used and they can include, for example, quaternary ammonium salts such as cetyl pyridyl chloride, BONTRON P-51, BONTRON P-53, BONTRON E-84, BONTRON E-81 (they are manufactured by OrientChemical Inds., LTD), salycilic acid type metal catalyst, phenolic condensates, tetraphenylic compounds, fine metal oxide particles and fine metal oxide powders surface treated with various kinds of coupling agents.

In two or more kinds of particles in the present invention, it is necessary that they are conditioned such that at least one kind of them is charged positively and at least one kind of the other of them can be charged negatively. When different kind of particles are charged by collision or friction, one of them is charged positively while the other of them is charged negatively depending on the positional relationship between them in the charging series. In the present invention, the position in the charging series can be adjusted appropriately by properly selecting the charge controller.

It is preferred that the charge controller used in the present invention is colorless, of less coloring capability or of a similar hue to that of the entire particles. The impact to the hue of the selected particles can be reduced by using the charge controller of similar hue to that of the entire particles (that is, color of similar hue to that of the colorant contained in the particles).

In this text, "colorless" means having no color and "less coloring capability" means having little effect on the color of the entire particles contained. "color of similar hue to that of the entire particles contained" means that the particles have a hue per se but this is identical or similar to that of the entire particles contained and, as a result, gives little effect on the color of the entire particles contained. For instance, in the particles containing the white pigment as the colorant, the white charge controller is contained within a category of "color or similar hue to that of the entire particles contained". Anyway, the color of the charge controller may be such one as rendering the color of the particles containing the controllers to a desired color irrespective of "colorless", "less coloring capability" or color of similar hue to that of the entire particles contained.

The size of the dispersion unit of the charge controller in the particles used in the present invention is 5 μm or less, preferably, 1 μm or less as the volume average grain size. Further, it may be present in a compatibilized state in the particles.

In the particles containing the charge controller in the present invention, the addition amount of the charge controller is preferably within a range from 0.1 to 10 mass % and, more preferably, 0.5 to 5 mass % based on the entire particles.

The particles in the present invention preferably contain further a resistance controller irrespective whether the particles contain the charge controller or not. Use of the resistance controller enables rapid charge exchange between particles to each other and attain early stabilization of the apparatus. The resistance controller means a fine conductive powder and, particularly, it is preferably a fine conductive powder of moderately causing changes of charge or leakage of charges. Coexistence of the resistance controller can avoid an increase of the charged amount of particles due to inter-particle friction or friction between the particles and the substrate surface for long time, that is, so-called charge up.

The resistance controller can include fine inorganic powders having a volumic resistivity of $1\times10^6$ Ωcm or less, preferably, $1\times10^4$ Ωcm. They can include, for example, tin oxide, zinc oxide, iron oxide and fine particles coated with various kinds of conductive oxides (for example, tin oxide-coated titanium oxide). In the present invention, the resistance controller is preferably colorless, of less coloring capability or of a hue similar to that of the entire particles contained. Definitions for the terms are the same as those explained for the charge controller. The addition amount of the resistance controller may be within a range not hindering the color of the particles and, specifically, it is preferably about 1 mass % to 10 mass % based on the entire particles.

The resin constituting the particles in the present invention can include, for example, polyolefin, polystyrene, acrylic resin, polyacrylonitrile, polyvinylic resins such as polyvinyl acetate, polyvinyl alcohol, vinyl chloride, polyvinyl butyral; vinyl chloride-vinyl acetate copolymer; styrene-acryl acid copolymer; straight silicone resin including organosiloxane bonds and modification products thereof; fluoro resin such as polytetrafluoro ethylene, polyvinylfluoride and polyvinylidene fluoride; polyester, polyurethane, polycarbonate; amino resin and epoxy resin. They may be used alone or plural resins may be used in admixture. The resins may be crosslinked. Further, known binder resins known as a main ingredient for toners used as electrophotographic toners can be used with no problems. Particularly, use of a resin containing crosslinking ingredient is preferred.

Referring to the grain size of the particles of two colors (for example, white particles and chromatic particles such as blue particles) chargeable positively or negatively, it is preferred that the grain size and the distribution of both of the particles may be substantially identical. By making the grain size and the distribution of both of the particles substantially identical, a deposit state such as in a so-called two component type developer in which a larger-size particles is surrounded with smaller-size particles can be avoided, so that high white density and chromatic density can be obtained. If there is a difference in grain size between both of them, small grain size particles are adhered to the periphery of large grain size particles to undesirably lower the color concentration inherent to the large grain size particles.

Further, since the color contrast changes also depending on the mixing ratio of colors of particles of two colors, if the grain size is substantially identical, it is preferred for such a mixing ratio that the number of particles of two colors is identical or similar. If the number of the particles of two colors differs greatly, the color of the particles at a greater ratio is predominant. However, this is not always applicable in a case of attaining contrast by the display of a dense tone and a display of pale tone each of the same color, or attaining display with a color formed by mixing particles of two kinds of colors.

The grain size of the particles in the present invention cannot be determined generally but it is, preferably, about from 1 to 100 μm and, more preferably, about from 3 to 30 μm and a mono dispersion is particularly preferred for the state of distribution.

The shape of the particles in the present invention is preferably of a substantially true spherical shape. In the particles of a substantially true spherical shape, particles are substantially in point-to-point contact with each other, and the contact between the particles and the inner surface of the substrate is also substantially in point-to-point contact to decrease the deposition force due to van der Waals force between the particles to each other and between the particles and the inner surface of the substrate. Accordingly, it is considered that even if the inner surface of the substrate is made of a dielectric material, the charged particles can be smoothly moved in the substrates by the electric field.

The manufacturing method for the particles in the present invention can include a wet production process such as suspension polymerization, emulsion polymerization or dispersion polymerization known as the manufacturing method for toners for use in electrophotography, as well as an existent pulverizing classification method. While particles obtained by the wet production process are spherical particles, particles obtained by the pulverization classification method are indefinite particles, so that it is desirable to apply a heat treatment so as to unify the shape of the particles.

[Constitution of the Substrate in the Invention]

The substrate in the present invention includes a pair of facing substrates in which the particles are sealed in the space between the pair of the substrates.

In the present invention, the substrate is a plate-like member having electroconductivity (conductive substrate) and it is necessary that at least one of the pair of the substrate is a transparent conductive substrate in order to provide a function as an image display medium. In this case, the transparent conductive substrate constitutes a display substrate.

The conductive substrate used in the present invention may be conductive by itself or the surface of an insulative substrate may be electrified. Further, it may be either crystalline or amorphous material. The conductive substrate in which the substrate itself is conductive can include, for example, those formed of metals such as aluminum, stainless steel, nickel and chromium and alloy crystals thereof, and semiconductors such as Si, GaAs, GaP, GaN, SiC and ZnO. The insulative support can include those formed of polymeric film, glass, quartz and ceramics. The insulative support can be electrified by forming a film with metals mentioned as a concrete example for the conductive substrate which is conductive by itself is, or gold, silver or copper by way of a vapor deposition method, a sputtering method or an ion plating method.

For the transparent conductive substrate, a conductive substrate in which a transparent electrode is formed on one surface of an insulative transparent support, or a transparent support having conductivity by itself is used. The transparent support having conductivity by itself can include those transparent conductive materials such as ITO, zinc oxide, tin oxide, lead oxide, indium oxide and copper iodide.

For the insulative transparent support, transparent inorganic materials such as glass, quartz, sapphire, MgO, LiF and $CaF_2$, as well as a film or a plate-like form of transparent organic resins such as fluoro resin, polyester, polycarbonate, polyethylene, polyethylene terephthalate and epoxy and further optical fibers and Selfoc can be used.

For the transparent substrate disposed on surface of the transparent support, those formed by using transparent electroconductive materials such as ITO, zinc oxide, tin oxide, lead oxide, indium oxide and copper iodide and formed by a method, for example, of vapor deposition, ion plating or sputtering, or those formed of a metal such as Al, Ni or Au in such a reduced thickness as become semitransparent by vapor deposition or sputtering.

In the substrates described above, since facing surfaces give undesired effects on the charging polarity of the particles, it is also a preferred embodiment to provide protection layers in the appropriate surface state. The protection layer can be selected mainly with a view point of bondability to the substrate, transparency and charging series, as well as low surface contamination. Specific materials for the protection layer can include, for example, polycarbonate resin, vinyl silicone resin and fluoro group-containing resin. Those having just a small difference from the constitution of main monomers of the particles used and frictional charging of the particles are selected,

[Embodiment of the Image Forming Apparatus of the Invention]

The embodiment of the image forming apparatus according to the present invention using the image display medium according to the present invention is to be explained specifically with reference to the drawings.

Figure 2:
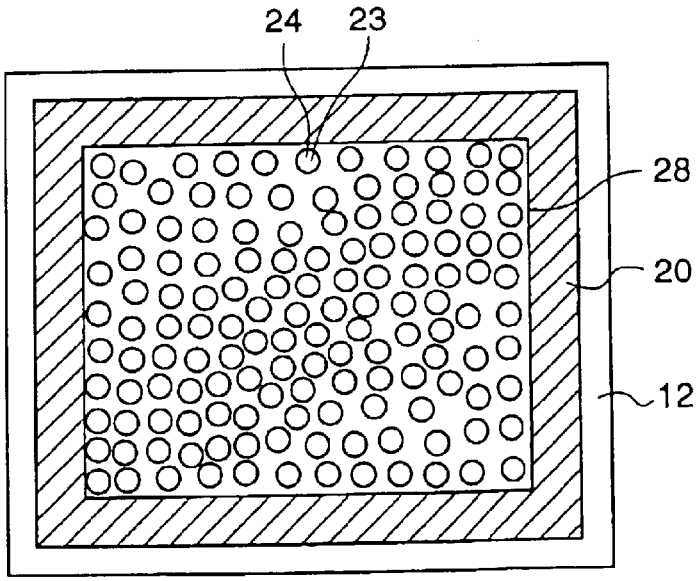
FIG. 2 is a cross-sectional view taken along line A—A of the image forming apparatus shown in FIG. 1.

FIG. 1 is a schematic constitutional view of an image forming apparatus of an embodiment according to the present invention, and FIG. 2 is a cross-sectional view taken along line A—A.

An image forming apparatus according to a preferred embodiment includes, as shown in FIG. 1, an image display medium 10 and a voltage generation unit 26. The image display medium 10 is an image display medium of the present invention and includes a display substrate 8, blue particles 22, white particles 24, a non-display substrate 18 and a spacer 20. The display substrate 8 is constituted by laminating a transparent electrode 4 and a protection layer 6 successively on one surface of a transparent support 2 and, in the same manner, the non-display substrate 18 is constituted by laminating an electrode 14 and a protection layer 16 successively on one surface of a support 12. Further, the transparent electrode 4 of the display substrate 8 is connected with the voltage generation unit 26 and the electrode 14 of the non-display substrate 18 is grounded to the earth.

Then, details for the image display medium 10 are to be explained. For the transparent substrate 2 and the transparent electrode 4, as well as the support 12 and the electrode 14 constituting the outsides of the image display medium 10 are made, for example, of 7059 glass substrates with transparent electrode ITO sized 50 mm×50 mm×1.1 mm. It is not always necessary that the support 12 and the electrode 14 on the side of the non-display substrate 18 are transparent. The inner surface of the glass substrate in contact with the particles (surfaces of the transparent electrodes 4 and 14) are coated with a polycarbonate resin (PC-Z) to a thickness of 5 $\mu$m to form the protection layers 6 and 16.

The spacer 20 is formed by providing a cutout 28 of 15×15 mm square to a central portion of a silicone rubber plate sized 40 mm×40 mm×0.3 mm to form a space upon disposition. The spacer 20 is constituted by placing the silicon rubber plate provided with the cutout 28 placed on the surface of the non-display substrate 18 formed with the electrode 14 and the protection layer 16.

About 15 mg of mixed particles including the blue particles 22 and the white particles 24 are sieved downwardly by way of a screen into a space formed by the cutout 28 of the spacer 20. Subsequently, the display substrate 8 is brought into an intimate contact with the spacer 20 such that the surface formed with the transparent electrode 4 and the protection layer 6 oppose the non-display substrate 18, and both of the substrates 8 and 18 are pressed and held by a double clip to bring the spacer 20 and both of the substrates 8 and 18 into close contact to form the image display medium 10.

When a DC voltage at 150 V is applied by the voltage generation unit 26 to the transparent electrode 4 of the display substrate 2 in the image display medium 10, a portion of the white particles 24 charged negatively on the side of the non-display substrate 18 start to move toward the display substrate 8 under the effect of an electric field and, when a DC voltage at 500 V is applied, a great amount of white particles 24 are moved to the display substrate 8 to substantially saturate the display density. In this case, the blue particles 22 charged positively move to the non-display substrate 18. Subsequently, even when the voltage applied by the voltage generation unit 26 is reduced to 0 V, the white particles 24 deposited on the display substrate 8 do not move to cause no change in the display density.

The image forming apparatus of the present invention using the display medium according to the present invention has been explained with reference to a preferred embodiment but the invention is not restricted to such an embodiment. For instance, white and blue have been mentioned as examples for the color of the particles but a combination of various colors may be adopted and, as has been described above, one of them is preferably white. Further, the size shown for each of the members is merely an example and various sizes of members can be selected depending on the purpose of use.

The image display medium according to the present invention as described above may be constituted as an image forming apparatus including plural image display media by disposing plural cells each as a unit including the constitution described above in a planer form (or constituting the cell in the space between facing substrates divisionally in a planer form). By increasing cells to a desired number in the longitudinal and lateral directions, an image forming apparatus of a large screen having a desired resolution power can be manufactured.

EXAMPLE

This invention is to be explained more specifically referring to examples.

In the following examples and the comparative example, the image display medium and the image forming apparatus of the constitution shown in FIG. 1 and FIG. 2 explained for the "Embodiment of the Image Forming Apparatus of the Invention" described previously were used and the constitution of the white particles and the blue particles were changed to confirm the effect of the present invention. In this case, the size, the material and the like for each of the members were made identical with those explained for the "Embodiment of the Image Forming Apparatus of the Invention" described previously.

<Preparation of Particles>

White particles and blue particles were prepared respectively as described above.

White Particle-1 a) Preparation of Liquid Dispersion A

Styrene monomer: 53 parts by weight

Titanium oxide (TAIPAKE CR63, manufactured by Ishihara Sangyo Co.): 45 parts by weight Charge controller (COPY CHARGE PHYVP 2038, manufactured by Clariant (Japan) K.K.): 2 parts by weight A mixture including the composition described above was pulverized by a ball mill for 20 hours using zirconia balls each of 10 mmϕ to obtain a liquid dispersion A.

b) Preparation of Calcium Carbonate Liquid Dispersion B

Calcium carbonate: 40 parts by weight

Water: 60 parts by weight

The mixture including the composition described above was finely pulverized by a ball mill in the same manner as that for the preparation of the liquid dispersion A to obtain calcium carbonate liquid dispersion B.

c) Preparation of Mixed Solution C

Aqueous 2% cellogen solution: 4.3 g

Calcium carbonate liquid dispersion B: 8.5 g

20% saline water: 50 g

The mixture including the composition described above was deaerated for 10 minutes by using a supersonic disperser and then stirred in emulsifying equipment to obtain a liquid mixture C.

d) Preparation of Particles 35 g of the liquid dispersion A, 1 g of divinyl benzene and 0.35 g of a polymerization initiator AIBN (azoisobutyronitrile) were weighed, thoroughly mixed and then deaerated for 10 minutes by a supersonic dispersing apparatus. They were put into the mixed solution C and emulsified by a emulsifying equipment. Then, after placing the liquid emulsion into a bottle, the bottle was plugged with silicone and sufficiently deaerated under a reduced pressure and then a nitrogen gas was sealed. Then, they were reacted at 70° C. for 10 hours to prepare particles. After cooling, they were taken out and then filtered, after decomposition of calcium carbonate with an excess amount of 3 mol/l hydrochloric acid. Subsequently, they were washed with a sufficient amount of distilled water and nylon sieves of 20 μm and 25 μm openings were used to collect a fraction passed through 25 μm sieve but remained on 20 μm sieve not passing therethrough and the grain size was made uniform. They were dried to prepare white particles-1 of a volume average grain size of 23 μm.

Blue Particle-1

(Blue Particle-1) was prepared by replacing the step for "(a) preparation for a the liquid dispersion A" with the following step in (White Particle-1) and conducting subsequent steps in (White Particles-1) by using the resultant liquid dispersion A'.

a) Preparation Liquid Dispersion A'

Styrene monomer: 87 parts by weight

Blue pigment (Pigment Blue 15:3, SANYO CYANINE BLUE KRO, manufactured by Sanyo Color Works, LTD.): 10 parts by weight Charge controller (BONTRON E-84, manufactured by Orient Chemicals): 2 parts by weight The mixture including the composition described above was pulverized by a ball mill using zirconia balls each of 10 mmϕ for 20 hours to obtain a liquid dispersion A'.

White Particle-2

White particle-2 was prepared in the same procedures as those for White Particle-1 except for not using the charge controller (COPY CHARGE PHYVP2038: manufactured by Clariant (Japan) KK) in the step for "(a) preparation for a the liquid dispersion A" and increasing the content of styrene by as much (2 parts by weight) in (White Particle-1).

Blue Particle-2

Blue particle-2 was prepared in the same procedures as those for White Particle-1 except for not using the charge controller (COPY CHARGE PHYVP2038: manufactured by Clariant (Japan) KK) in the step for "(a) preparation for a the liquid dispersion A'" and increasing the content of styrene by as much (2 parts by weight) in (White Particle-1).

<Preparation of Mixed Particles>

Each of the particles obtained as described above was used in combination shown in the following Table 1 and mixed to prepare mixed particles used in the examples and the comparative example. The blending ratio between the white particles and the blue particles (on the number basis) was set as: white particle: blue particle=2:1.

TABLE 1

| | White particles | Blue particles |
|---|---|---|
| Example 1 | White particle-1 | Blue particle-1 |
| Example 2 | White particle-1 | Blue particle-2 |
| Example 3 | White particle-2 | Blue particle-1 |
| Comp. Example 1 | White particle-2 | Blue particle-2 |

Each of the mixed particles thus obtained was sealed in a space between facing substrates (display substrate 8 and non-display substrate 18).

A voltage (500 V) was applied between the transparent electrode 4 and electrode 14 of the image forming apparatus obtained and a desired electric field was exerted on the particle group between the display substrate 8 and the non-display substrate 18 to move respective particles 22 and 24 between the display substrate 8 and the non-display substrate 18. By switching the polarity of the voltage applied, each of the particles 22 and the 24 were moved in the direction different from each other between the display substrate 8 and the non-display substrate 18 and reciprocated between the display substrate 8 and the non-display substrate 18 by switching the polarity of the voltage repetitively. In this process, the particles 22 and the particles 24 are charged respectively to the polarity different from each other by collision between the particles 22 and 24 and between the particles 22, 24 and the display substrate 8 or non-display substrate 18.

In this example, the white particles-1 were charged positively while the blue particles-1 were charged negatively and moved in the directions different from each other in accordance with the electric field between the display substrate 8 and the non-display substrate 18. When the electric field was fixed at one direction, the particles 22 and 24 were deposited to the display substrate 8 or the non-display substrate 18, respectively, to display images of a uniform high density with no image unevenness and at high contrast.

In the image forming apparatus using each of the mixed particles of the examples or the comparative example, the polarity of the voltage was switched on every one second and the particles 22, 24 were moved, respectively, on every one second to different directions between the display substrate 8 and the non-display substrate 18. The switching was repeated for 1600 cycles. Subsequently, the polarity of the voltage was switched on every 0.1 sec. Then, switching of the polarity was repeated up to 10,000 cycles in total and the displayed images were evaluated. The result is shown in the following Table 2. The standard for the evaluation is as shown below.

A: No or little unevenness in the density of display image, no or little lowering of the reflection density B: Unevenness in the density of the display image and lowering of the reflection density observed partially, but with sufficient viewability.

C: Remarkable lowering of reflection density observed

TABLE 2

| | Evaluation result for display image after 10000 cycles |
|---|---|
| Example 1 | A |
| Example 2 | B |
| Example 3 | B |
| Comp. Example 1 | C |

Since plural particles frictionally chargeable with each other were used, plural electrodes disposed in parallel may suffice as the mechanism for image display, which can simplify the structure of the image display medium. Further, since the charge controller was added to one of the plural particles frictionally chargeable with each other, stability of the frictionally charged charges of the particles between the substrates (aging and circumstantial) was high. Since this can reduce the deviation for the potential difference between each of the particles, a contrast image stable and with little unevenness as the image display medium can be provided.

As has been explained above, the present invention can provide an image display medium and an image forming apparatus using the same, with little change in the display image density, with little change of the uniformity of the display image density and at stable density contrast even when the display images are rewritten repetitively over a long period of time.

The entire disclosure of Japanese Patent Application No. 2000–300961 filed on Sep. 29, 2000 including specification, claims, drawings and abstract is incorporated herein by reference in its entirety.

What is claimed is:

1. An image display medium comprising:

a pair of facing substrates; and at least two kinds of particles sealed in a space between the pair of substrates, wherein the at least two kinds of particles, each having only a single color, have a characteristic that at least one kind of them is positively chargeable and at least one other kind of them is negatively chargeable, and the particles chargeable positively and negatively are of colors different from each other, and a charge controller is internally added to one or both of the particles chargeable positively and negatively.

2. The image display medium according to claim 1, wherein the charge controller is colorless, of less coloring capability or of a hue similar to that of the entire particles contained.

3. The image display medium according to claim 1, wherein one of particles chargeable positively and negatively is white.

4. The image display medium according to claim 3, wherein the white particles contain a colorant and the colorant is titanium oxide.

5. An image forming apparatus for forming an image to the image display medium according to claim 1, comprising:

an electric field generation unit that generates an electric field in accordance with images disposed between the pair of substrates.

6. An image display medium comprising:

a pair of facing substrates;

at least two kinds of insulative non-magnetic fine particles each only having a single color and also having frictional chargeability between each other disposed between the substrates; and an electric field generation unit that provides the electric field to the insulative non-magnetic fine particles, the two kinds of insulative non-magnetic fine particles being fine partioles of colors different from each other and frictionally chargeable to polarities different from each other.

7. The image display medium according to claim 6, wherein the electric field generation unit comprises a pair of electrodes disposed between the pair of substrates and the fine insulative non-magnetic particles.

8. The image display medium according to claim 7, wherein the electrode is a flat plate electrode connected with a power source.

9. The image display medium according to claim 6, wherein the pair of substrates are insulative substrates.

* * * * *